US009370860B2

(12) United States Patent
Rieger et al.

(10) Patent No.: US 9,370,860 B2
(45) Date of Patent: Jun. 21, 2016

(54) HANDLE DEVICE, IN PARTICULAR FOR HAND TOOLS

(75) Inventors: Andreas Rieger, Leinfelden-Echterdingen (DE); Carsten Diem, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 166 days.

(21) Appl. No.: 14/129,847

(22) PCT Filed: Jun. 14, 2012

(86) PCT No.: PCT/EP2012/061309

§ 371 (c)(1),
(2), (4) Date: Apr. 18, 2014

(87) PCT Pub. No.: WO2013/000724

PCT Pub. Date: Jan. 3, 2013

(65) Prior Publication Data

US 2014/0223695 A1 Aug. 14, 2014

(30) Foreign Application Priority Data

Jun. 30, 2011 (DE) ..... 10 2011 078 376

(51) Int. Cl.

*B25G 1/01* (2006.01)
*B25F 5/00* (2006.01)
*B25F 5/02* (2006.01)

(52) U.S. Cl.

CPC . *B25G 1/01* (2013.01); *B25F 5/006* (2013.01); *B25F 5/026* (2013.01); *Y10T 16/466* (2015.01); *Y10T 16/4713* (2015.01); *Y10T 16/48* (2015.01); *Y10T 16/498* (2015.01)

(58) Field of Classification Search

CPC ..... B25D 17/04; B25D 17/043; B25D 5/006; B25D 5/026; B25D 1/01; Y10T 16/48; Y10T 16/498; Y10T 16/466; Y10T 16/4713; Y10S 16/19; Y10S 16/12

See application file for complete search history.

(56) References Cited

U.S. PATENT DOCUMENTS 264,798 A * 9/1882 Tyler ..... B25G 1/105 16/431
281,626 A * 7/1883 French ..... B23B 31/1179 279/102

(Continued)

FOREIGN PATENT DOCUMENTS

CN 2537524 Y 2/2003
CN 1840295 A 10/2006

(Continued)

OTHER PUBLICATIONS

International Search Report corresponding to PCT Application No. PCT/EP2012/061309, mailed Aug. 22, 2012 (German and English language document) (8 pages).

*Primary Examiner* — Jeffrey O Brien
(74) *Attorney, Agent, or Firm* — Maginot, Moore & Beck LLP

(57) ABSTRACT

A handle device, in particular for a hand tool, includes a grip unit and a fastening unit. A resiliently elastic damping unit is arranged between the grip unit and the fastening unit. The damping unit is configured to transmit a vibration that occurs on the fastening unit in the operating state of the handle device to the grip unit in an at least partially damped manner so that a user is decoupled at least partially from the vibration. An overload protection unit is configured to protect the damping unit from damage in the event of an overload state occurring on the grip unit or on the fastening unit by diverting at least part of a force flux between the fastening unit and the grip unit to an additional force flux path as a bypass during the overload state.

16 Claims, 6 Drawing Sheets

(56) References Cited

U.S. PATENT DOCUMENTS 450,906 A * 4/1891 Blakely ..... B62K 21/26 16/421
786,050 A * 3/1905 Richwood ..... B25D 17/24 173/162.1
2,921,326 A * 1/1960 Lautmann ..... A46B 5/0095 15/145
3,302,673 A * 2/1967 Forsberg ..... B25B 23/16 16/430
3,559,512 A * 2/1971 Aggarwal ..... B23B 29/022 188/322.5
RE29,402 E * 9/1977 Shotwell ..... B25D 17/04 16/431
4,368,556 A * 1/1983 Wanner ..... B23B 45/001 16/436
4,381,579 A * 5/1983 Rumpp ..... B25G 1/10 16/431
4,452,289 A * 6/1984 Smith ..... B25G 1/085 74/551.9
4,611,671 A * 9/1986 Hansson ..... B25F 5/006 173/162.2
4,660,832 A * 4/1987 Shomo ..... A63B 49/08 16/431
4,820,090 A * 4/1989 Chen ..... B25F 5/027 16/431
4,834,596 A * 5/1989 Hollifield ..... B23B 31/113 279/101
4,881,294 A * 11/1989 Riedl ..... B25F 5/003 16/426
4,972,733 A * 11/1990 Olmr ..... B25D 17/043 74/551.9
5,038,480 A * 8/1991 Naslund ..... B27B 17/0033 173/162.2
5,157,807 A * 10/1992 Keller ..... B25D 17/043 16/431
5,170,532 A * 12/1992 Holmin ..... B25D 17/043 16/431
5,269,045 A * 12/1993 DeSerio ..... B25D 17/043 16/422
5,273,120 A * 12/1993 Chang ..... B25D 17/043 16/431
5,365,637 A * 11/1994 Bodell ..... B25D 17/043 16/431
5,400,860 A * 3/1995 Best ..... B25D 17/24 173/162.2
5,701,998 A * 12/1997 Perry ..... A63B 49/18 16/436
5,740,586 A * 4/1998 Gomas ..... B25G 1/10 16/430
5,769,174 A * 6/1998 Lee ..... F16F 7/104 173/162.1
5,848,453 A * 12/1998 Racodon ..... B25G 1/01 16/16
6,349,451 B1 * 2/2002 Newman ..... A46B 17/02 15/145
6,361,317 B1 * 3/2002 Rahman ..... A61C 3/00 433/141
6,497,007 B2 * 12/2002 Newman ..... A46B 17/02 15/145
6,595,300 B2 * 7/2003 Milbourne ..... B25B 21/00 16/431
6,776,244 B2 * 8/2004 Milbourne ..... B25B 21/00 16/431
6,820,523 B1 * 11/2004 Chen ..... B25B 13/462 81/177.1
6,832,413 B1 * 12/2004 Applewhite ..... B25G 1/102 16/430
6,959,469 B2 * 11/2005 Blauer ..... A45C 13/26 135/25.4
6,968,599 B2 * 11/2005 Blauer ..... A45C 13/26 135/25.4
6,974,626 B2 * 12/2005 Horacek ..... A63B 49/08 16/110.1
7,000,709 B2 * 2/2006 Milbourne ..... B25B 21/00 16/431
7,191,494 B2 * 3/2007 Badiali ..... B25F 5/026 16/426
7,234,205 B2 * 6/2007 Blauer ..... A45B 9/02 135/25.4
7,252,156 B2 * 8/2007 Sugiyama ..... B25F 5/026 173/162.1
7,401,661 B2 * 7/2008 Berghauser ..... B25D 17/24 173/109
7,676,890 B2 * 3/2010 Zhang ..... B25F 5/006 16/421
8,141,209 B2 * 3/2012 Zhang ..... B25F 5/006 16/421
8,522,894 B2 * 9/2013 Kraenzler ..... B25F 5/006 173/162.1
2004/0016082 A1 * 1/2004 Yi ..... B25F 5/006 16/421
2004/0205937 A1 * 10/2004 Blauer ..... A45C 13/26 16/431
2004/0205938 A1 * 10/2004 Blauer ..... A45C 13/26 16/431
2005/0034276 A1 * 2/2005 Badiali ..... B25F 5/026 16/426
2005/0087353 A1 * 4/2005 Oki ..... B25D 17/043 173/162.2
2005/0224244 A1 * 10/2005 Kraenzler ..... B25F 5/026 173/162.1
2006/0169308 A1 * 8/2006 Yen ..... A45B 9/02 135/25.4
2006/0219419 A1 * 10/2006 Sugiyama ..... B25F 5/026 173/162.2
2006/0275090 A1 * 12/2006 Onozuka ..... B23B 29/022 408/143
2007/0074374 A1 * 4/2007 Chen ..... B25G 1/102 16/431
2007/0089274 A1 * 4/2007 Zhang ..... B25F 5/006 16/431
2007/0094848 A1 * 5/2007 Chen ..... A45B 9/02 16/431
2007/0107165 A1 * 5/2007 Oddo ..... B25D 17/043 16/431
2007/0143966 A1 * 6/2007 Fischer ..... B25F 5/006 16/422
2007/0151404 A1 * 7/2007 Kuwata ..... B62K 21/125 74/551.8
2007/0295376 A1 * 12/2007 Liu ..... A45B 9/02 135/25.4
2008/0006426 A1 * 1/2008 Friedrich ..... B03C 1/286 173/210
2008/0148524 A1 * 6/2008 Wiker ..... B25F 5/006 16/431
2008/0223593 A1 * 9/2008 Eicher ..... B25D 17/043 173/162.2
2008/0235913 A1 * 10/2008 Eicher ..... B25F 5/006 16/430
2009/0038120 A1 * 2/2009 Eicher ..... B24B 23/028 16/426
2009/0038899 A1 * 2/2009 Eicher ..... B25F 5/026 188/378
2009/0064829 A1 * 3/2009 Frank ..... B25F 5/006 81/489
2009/0178243 A1 * 7/2009 Frank ..... B25F 5/006 16/421
2009/0188083 A1 * 7/2009 Hahn ..... B25F 5/026 16/426
2009/0283283 A1 * 11/2009 Oesterle ..... B25F 5/026 173/162.2
2010/0206595 A1 * 8/2010 Kamegai ..... B25F 5/006 173/162.2
2010/0282484 A1 * 11/2010 Moessnang ..... B25D 17/043 173/162.2
2011/0005790 A1 * 1/2011 Frank ..... B25F 5/006 173/162.2
2012/0012353 A1 * 1/2012 Foerster ..... B25F 5/006 173/162.2

(56) References Cited

U.S. PATENT DOCUMENTS

| | | | | |
|---|---|---|---|---|
| 2013/0025088 | A1* | 1/2013 | Weiss | B25D 17/043 16/431 |
| 2013/0185899 | A1* | 7/2013 | Zhang | B25F 5/006 16/431 |

FOREIGN PATENT DOCUMENTS

| | | | | | |
|---|---|---|---|---|---|
| CN | 101362322 | A | | 2/2009 | |
| CN | 101903136 | A | | 12/2010 | |
| DE | 100 29 536 | A1 | | 12/2001 | |
| DE | 10 2007 047 881 | A1 | | 6/2009 | |
| DE | 10 2007 059 556 | A1 | | 6/2009 | |
| DE | 10 2007 062 720 | A1 | | 7/2009 | |
| DE | 10 2008 000 516 | A1 | | 9/2009 | |
| EP | 0 849 492 | A2 | | 6/1998 | |
| EP | 1 800 807 | A1 | | 6/2007 | |
| EP | 2 191 941 | A2 | | 6/2010 | |
| GB | 2080919 | A | * | 2/1982 | B24B 23/02 |
| GB | 2086005 | A | * | 5/1982 | B25D 17/043 |
| GB | 2 451 747 | A | | 2/2009 | |
| JP | 1882560 | A2 | * | 1/2008 | B25D 17/043 |
| WO | 2011/001979 | A1 | | 1/2011 | |

* cited by examiner

HANDLE DEVICE, IN PARTICULAR FOR HAND TOOLS

This application is a 35 U.S.C. §371 National Stage Application of PCT/EP2012/061309, filed on Jun. 14, 2012, which claims the benefit of priority to Serial No. DE 10 2011 078 376.8, filed on Jun. 30, 2011 in Germany, the disclosures of which are incorporated herein by reference in their entirety.

BACKGROUND

The disclosure relates to a handle device, in particular for a hand tool, preferably for a motor-driven hand tool. In this case, the expression "motor-driven" should be understood in particular to mean a drive of the hand tool having an electromotive, piezoelectric or electromagnetic drive principle, but also a drive by means of a fluid motor or combustion engine.

Handle devices comprising a grip unit and a fastening unit are already known, wherein a spring-elastic damping unit is arranged between the grip unit and the fastening unit. A grip unit is understood in this case to mean in particular a unit or an element which can be grasped, fixed or held by at least one hand of an operator in order to guide the hand tool. To this end, the grip unit has preferably a bar-like grip element. A fastening unit is understood to mean in particular a unit or device which is provided or designed to connect the grip unit to the hand tool, preferably releasably, wherein the term "connect" is understood to mean in particular to connect spatially in a substantially fixable manner with respect to the hand tool, in particular a housing of the hand tool. The damping unit is provided to transmit a vibration that occurs on the fastening unit in an operating state of the handle device or of the hand tool to the grip unit in an at least partially damped manner such that an operator is at least partially decoupled from the vibration.

Such a handle device is known for example from DE 100 29 536 A1, wherein the fastening unit comprises a fastening part and a threaded pin for connecting to a housing of a hand tool. In this case, the damping unit is manufactured from a more elastic material than the grip unit. Furthermore, the handle device in DE 100 29 536 A1 has at least one securing element which is intended to prevent the grip unit from detaching from the fastening unit, were the damping unit to be damaged or even destroyed for example in an overload situation or an overload state. Thus, as a result of overloads, for example damping units which comprise a rubber-elastic or elastomeric damping element can be permanently deformed, overextended or, as a result of extreme overstretching, torn.

Such overload states of the damping units occur inter alia in the event of impact loads on the hand tool or the handle device, in particular on the grip element, which are caused inter alia by the hand tool being dropped or falling.

SUMMARY

It is an aim of the present disclosure to provide a handle device which has particularly high overload resistance. Ideally, the handle device according to the disclosure is in this case simultaneously cost-effective easy to produce.

This is achieved advantageously by the handle device having the features of the disclosure. According to the disclosure, provision is made to this end of an overload protection unit which, in the event of an overload state occurring on the grip unit or on the fastening unit, protects the damping unit from damage by at least a part of a force flux between the fastening unit and the grip unit being diverted, in the overload state, as a bypass to an additional force flux path. In this case, a force flux path is understood to mean in particular a spatial route of a force propagation, in particular over body structures of the handle device. A diversion of a part of a force flux to an additional force flux path should be understood in this case in particular to mean that a part of the force flux which is directed substantially entirely via a first body structure—in particular the damping unit—in a regular operating state is directed past the first body structure via a further body structure—in particular the overload protection unit—in a second state, primarily the overload state.

Preferably, the part of the diverted force flux makes up at least 25%, preferably at least 50% or particularly preferably at least 75% of the overall force flux which occurs and results in particular from the overload state.

The measures stated in the dependent claims produce advantageous developments and improvements of the features specified in the disclosure.

If the additional force flux path extends in a manner substantially parallel to a force flux path via the damping unit, the overload protection device can be configured advantageously in a compact manner.

A preferred embodiment of the handle device according to the disclosure is achieved when the grip unit comprises at least one main grip body, and preferably consists of the main grip body. As a result, in particular the number of components of the handle device is advantageously reduced. A main grip body is understood in this case to mean in particular a bar-like, in particular dimensionally stable grip body, preferably a cylindrical or hollow-cylindrical grip body. The main grip body is in this case manufactured in particular from a first material, preferably a thermoplastic or some other plastics material, in particular an injectable, castable or injection-moldable plastics material.

A further advantageous configuration is achieved when the fastening unit comprises at least one main body. A main body is understood in this case to mean a substantially dimensionally stable body which is designed in particular to absorb and/or transmit the force fluxes that occur between the grip unit and the hand tool, in particular a housing of the hand tool, in particular without itself being subjected to substantial elastic and/or plastic deformations compared with an unloaded state.

In an advantageously cost-effective and assembly-friendly embodiment, the damping unit of the handle device according to the disclosure is connected to the main grip body and/or main body. In a preferred configuration, the damping unit is in this case connected as one part to the main grip body and/or the main body.

In a further preferred configuration, at least two, preferably all three elements from the group consisting of the main grip body, the damping unit and the main body are manufactured from the first material.

A cost-effective configuration of the damping unit according to the disclosure is achieved when the latter comprises a defined number—preferably at least 4, 6 or particularly preferably 8—of bending elements which substantially enclose a grip axis of the grip unit in the circumferential direction of the grip axis. A bending element is understood in this case to mean an element which is deformable in a substantially elastic manner at least in one spatial direction compared with a rest position. Preferably, this spatial direction extends in a manner substantially perpendicular to the grip axis. Furthermore, the enclosure of the grip axis should be understood to mean in particular an arrangement which is circular, elliptical or polygonal, as seen in a cross section along the grip axis, and located substantially on a closed cross-sectional line. In a particularly preferred configuration, the bending elements are arranged in a manner directed substantially radially, in particular in a radiating manner away from the grip axis.

A particularly effective overload protection unit according to the disclosure has a hollow-cylinder-like support element which at least partially, preferably virtually entirely, surrounds the damping unit in the circumferential direction. A hollow-cylinder-like support element is understood in this case to mean in particular an element which is suitable for supporting the grip unit with respect to the fastening unit and in this case has a cross-sectional line which is circular, elliptical or polygonal, as seen along the grip axis, and is preferably substantially closed. However, it may also be advantageous for the support element to be constructed along the cross-sectional line from support segments which are interrupted with respect to the cross-sectional line.

In a preferred configuration, the overload protection unit, in particular the hollow-cylinder-like support element, is connected to the main grip body of the grip unit or to the main body of the fastening unit, and is preferably formed as one part therewith. Preferably, a support surface is provided on the in each case other body—the main body or the main grip body—said support surface being provided to come or be brought into contact in a force transmitting manner at least with a part of a contact surface which is provided on the support element.

In a preferred configuration, a contact spacing is provided between the contact surface and the support surface in a rest state of the handle device according to the disclosure. The contact spacing can in this case preferably be configured to be substantially constant over a circumference. However, it may also be advantageous for the contact spacing to be a function of a circumferential angle, in particular a circumferential angle with respect to the grip axis.

The contact spacing is in this case selected such that the contact surface cannot come into contact with the support surface in a regular operating state, even when the damping unit is acting in a vibration-damping manner, wherein the grip unit can be deflected from a rest position relative to the fastening unit. In particular as a result of this, the overall force flux between the fastening unit and the grip unit of the handle device according to the disclosure flows in an undivided manner via the damping unit and can be advantageously damped in a corresponding manner.

However, if an overload state occurs, the contact spacing can be reduced by a deflection of the grip unit relative to the fastening unit such that the support surface comes into supporting contact with the contact surface at least so as to be touching in a locally limited manner. Over the supporting contact surface which arises, an additional force flux path arises by way of example as an advantageous example of the disclosure, and a part of the overall force flux can now flow past the damping unit.

In an advantageous further development of the handle device according to the disclosure, at least one torsion inhibiting means is provided on the fastening unit and on the grip unit, said torsion inhibiting means limiting torsional moments acting on the damping unit to a maximum in the event of torsion of the grip unit relative to the fastening unit, in particular about the grip axis.

In a preferred embodiment, the torsion inhibiting means comprises at least one recess and at least one torsion blade engaging in the recess. In this case, the recess and the torsion blade are arranged in a manner mutually assigned to one another on the fastening unit and on the grip unit, preferably on the overload protection unit.

Further advantageous embodiments and developments can be gathered from the combination of the above-described features and the features of the exemplary embodiments described in the following text.

BRIEF DESCRIPTION OF THE DRAWINGS (An) exemplary embodiment(s) of the disclosure is/are illustrated in the drawings and explained in more detail in the following description. In the drawings.

Figure 7:
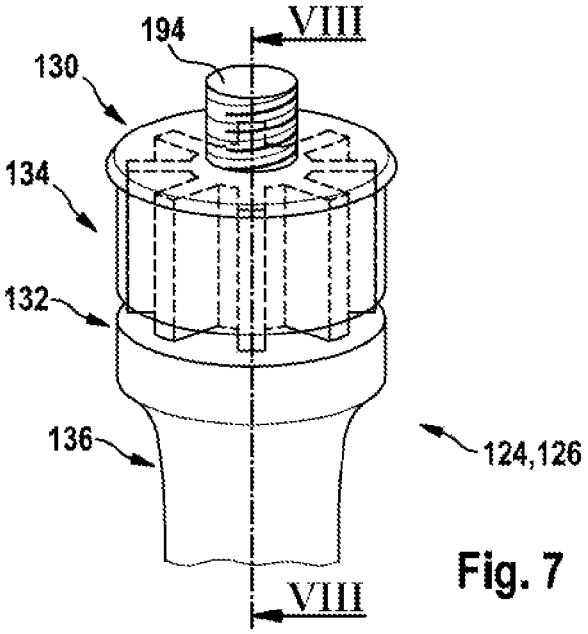
FIG. 7 shows a schematic view of a further exemplary embodiment of a handle device according to the disclosure similar to FIG. 6
Figure 8A:
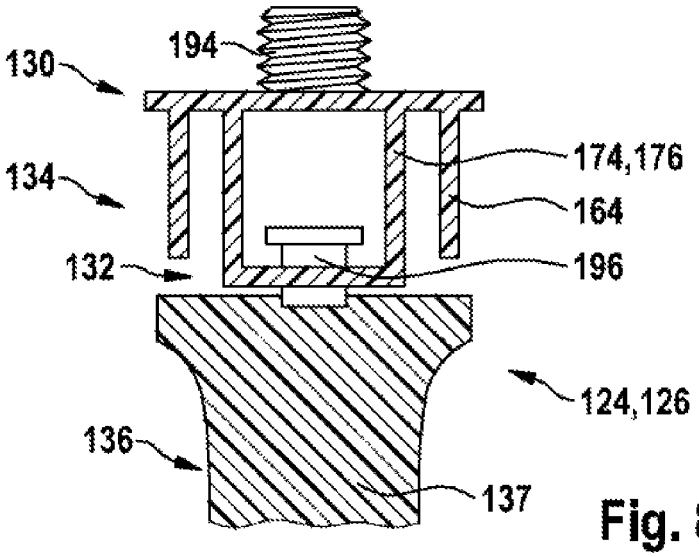

FIG. 8*a* shows sectional views of the exemplary embodiment according to FIG. 7

Figure 8B:
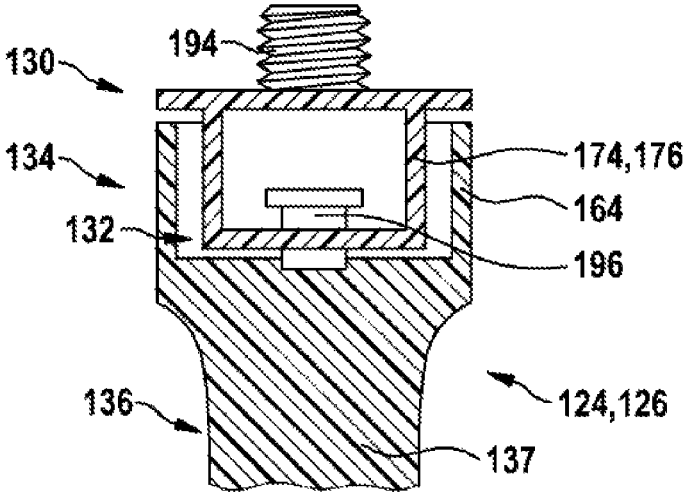

FIG. 8*b* shows a variant of the example according to FIG. 8*a* as an alternative embodiment

DESCRIPTION OF THE EXEMPLARY EMBODIMENTS

Figure 1:
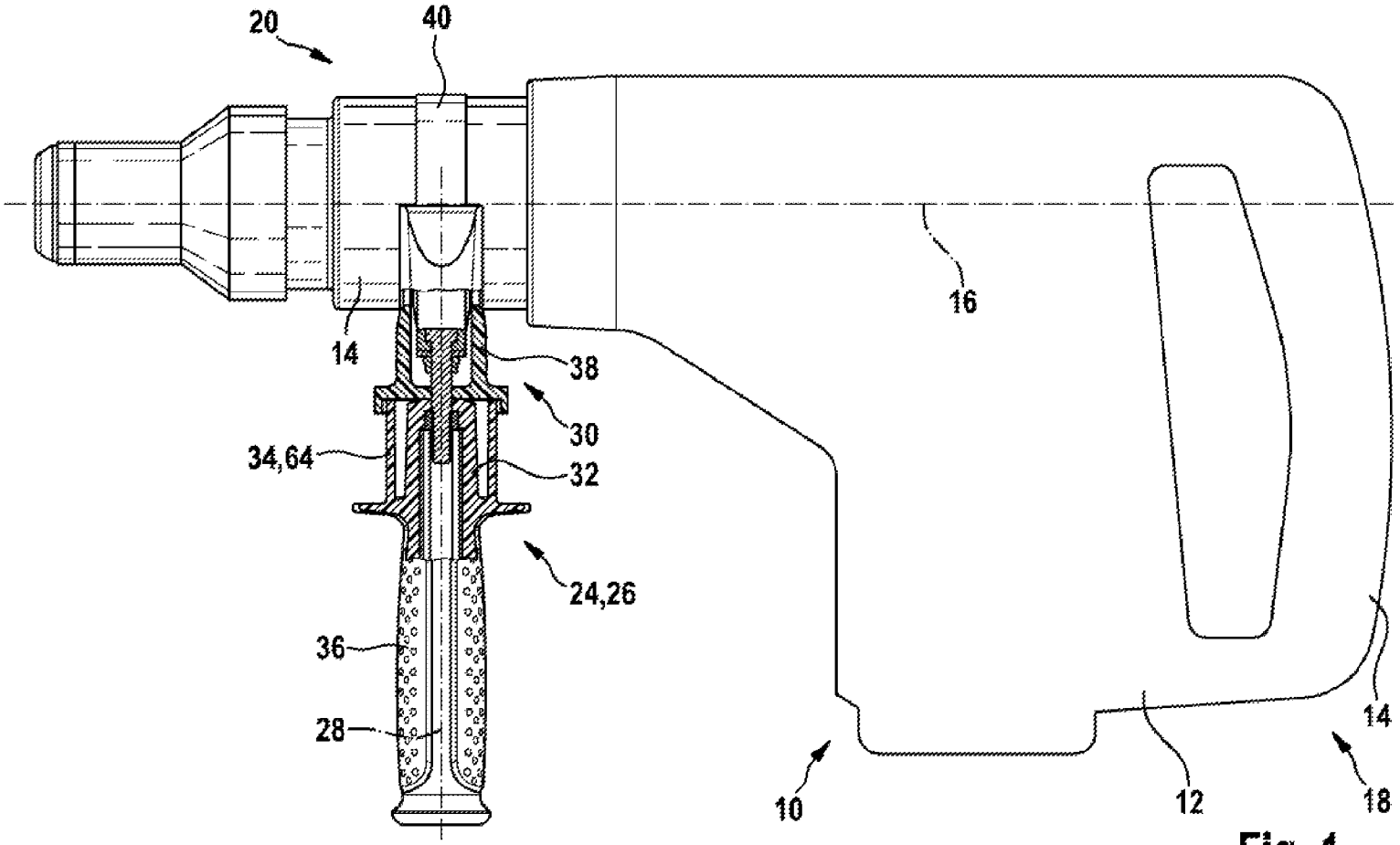
FIG. 1 shows a schematic view of an electric hand tool having a first exemplary embodiment of a handle device according to the disclosure in the form of an auxiliary handle

FIG. 1 shows a hammer drill 10 as an example of a hand tool, in particular a motor-driven hand tool. The hammer drill 10 comprises a housing 12 having a main handle 14 which is integrally formed for example. The main handle 14 is in this case arranged along a main axis 16 in a rear end region 18 of the housing 12. Provided on a cylindrical neck region 20 located substantially opposite the main handle 14 is a tool holder 22 for receiving a work tool, not illustrated here. In this case, the tool holder 22 of the hammer drill 10 is arranged in a substantially rotatable manner on the neck region 20 of the housing 12.

Also arranged on the neck region 20 is a handle device 24 according to the disclosure. In this case, the handle device 24 is in the form of an auxiliary handle 26 of the hammer drill 10. In the example according to FIG. 1, the auxiliary handle 24, 26 has a grip axis 28 which is oriented substantially perpendicularly to the main axis 16 of the hammer drill 10. This is the case in particular in a rest state of the hammer drill 10. The auxiliary handle 24, 26 comprises a fastening unit 30, which is adjoined along the grip axis 28, directed away from the neck region 20, by a damping unit 32 and an overload protection unit 34 according to the disclosure, and said auxiliary handle also comprises a grip unit 36 connected to the fastening unit by the damping unit 32.

The fastening unit 30 according to FIG. 1 comprises a main body 38 and a clamping band device 40, as is for example well known for example from EP 2 191 941 A2, DE 10 2008 000 516 A1 or DE 10 2007 047 881 A1, reference being explicitly made to the disclosure of said documents. By means of the clamping band device 40, the auxiliary handle can be releasably fixed to the housing 12 in a relative rotational position about the cylindrical neck region 20.

Figure 2:
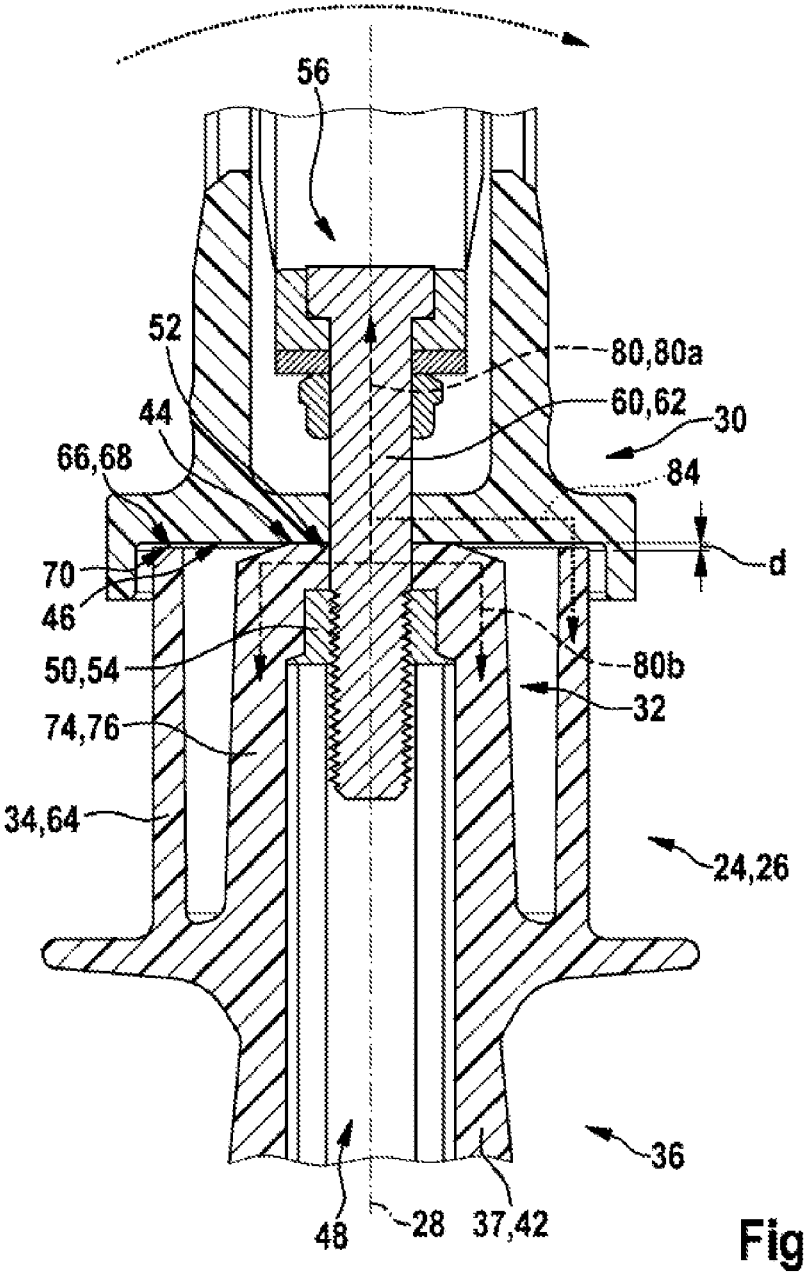
FIG. 2 shows a sectional view through a region of the handle device according to FIG. 1

FIG. 2 shows the region between the main body 38 and an upper end region of the grip unit 36 from FIG. 1 in an enlarged illustration. In this exemplary embodiment, the damping unit 32 and the overload protection unit 34 are formed as one part with the grip unit 36, in particular a main grip body 37. Preferably, the damping unit 32, the overload protection unit 34 and the main grip body 37 are produced from a first material 42—preferably a thermoplastic or some other plastics material, in particular an injectable, castable or injection-moldable plastics material.

The damping unit 32 has a first bearing surface 44 facing away from the grip unit 36. The main body 38 of the fastening unit 30 has a second bearing surface 46 which is provided in particular to support the first bearing surface 44 of the damping unit 32.

Arranged in a cavity 48 that extends through the grip unit 36 and the damping unit 32 along the grip axis 28 is a clamping nut 50. The clamping nut 50 is in this case received in the cavity 48 in a rotationally fixed manner about the grip axis 28. It is in this case placed preferably substantially beneath the first bearing surface 44 along the grip axis 28.

The first bearing surface 44 has a bore 52 which is provided in a substantially concentric manner with the grip axis 28, said bore 52 being arranged in a substantially coaxial manner with an internal thread 54 of the clamping nut 50.

The fastening unit 30 furthermore has a clamping space 56 which for its part a bore 58 for passing through a clamping screw 60 arranged in the clamping space 56 is provided in an end region facing the grip unit 36. The clamping screw 60 has external thread 62 matching the internal thread 54, such that the damping unit 32 is connectable to the fastening unit 30 by means of the clamping screw 60. In particular, by appropriately tightening the clamping screw 60 in the clamping nut 50, the first and second bearing surfaces 44, 46 come into contact with one another such that the damping unit 32 is supported on the fastening unit 30, thereby defining a rest position of the grip unit 36 relative to the second bearing surface 46. In the example according to FIGS. 1 and 2, this rest position is substantially parallel to, preferably coaxial with, the grip axis 28, such that the grip element 36 is oriented in a substantially perpendicular manner with respect to the main axis 16 in the rest position.

In the example according to FIG. 1 and FIG. 2, the overload protection unit 34 is in the form of a hollow-cylindrical support element 64. The latter is embodied here advantageously as one part with the main grip body 37. The hollow-cylindrical support element 64 is arranged radially on the outside with respect to the damping unit 32 and extends preferably in a substantially coaxial manner about the damping unit 32.

An end face 66, facing the fastening unit 30, of the hollow-cylindrical support element 64 is in this case configured according to FIG. 2 as contact surface 68. The part, opposite the contact surface 68, of the second bearing surface 46 on the main body 38 of the fastening unit 30 is in this case provided as a support surface 70 for supporting the contact surface 68.

In the rest position, illustrated in FIG. 2, of the handle device 24, 26 according to the disclosure, a contact spacing d is provided between the contact surface 68 and the support surface 70. In the preferred embodiment according to FIG. 2, the contact spacing d is in this case configured in a substantially constant manner over a circumferential angle extending around the grip axis 28 in the rest state. However, it may also be advantageous for the contact spacing d to be a function of the circumferential angle. In particular, it may be advantageous for the contact spacing d to be selected to deviate, in particular to be larger, in angular positions substantially parallel to a main oscillating direction of the vibrations that occur, than in angular positions which extend substantially transversely to the main oscillating direction.

Figure 3:
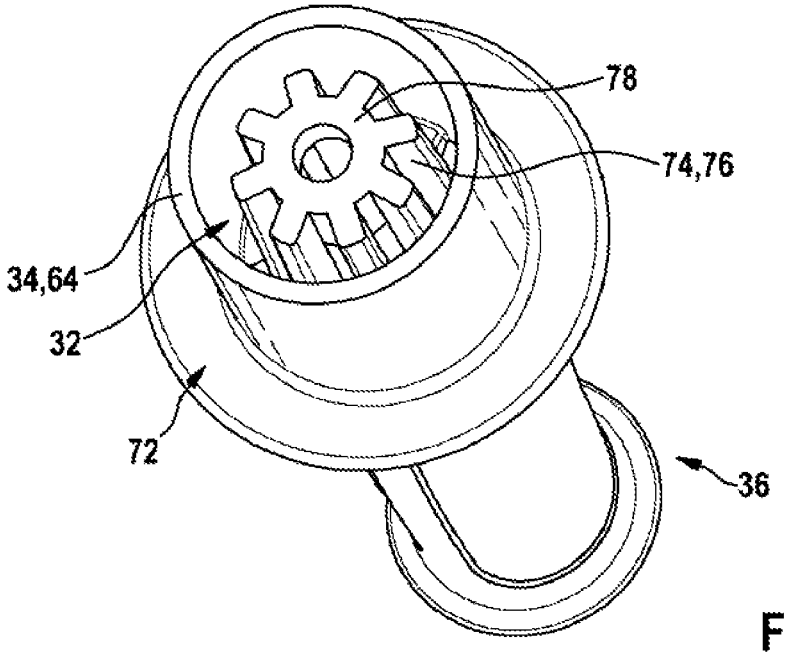
FIG. 3 shows a view of the grip unit according to the disclosure according to FIG. 1

FIG. 3 shows a three-dimensional view of an end region 72 of the grip unit 36 according to the exemplary embodiment in FIGS. 1 and 2. In this case, in particular the overload protection unit 34 configured as a hollow-cylindrical support element 64 and also the damping unit 32 according to FIG. 2 can be seen. The damping unit 32, arranged centrally around the grip axis 28, is configured for example in a coaxial manner with the support element 64 and has, in the example according to FIG. 3, a plurality of, in particular eight, rib-like bending elements 74. The bending elements 74 are in this case configured preferably as bending beams 76. In this case, the bending beams 74, 76 merge at their ends facing the end region into an end cap 78 on which the first bearing surface 44 is provided. At their end opposite the end cap 78, the bending beams 74, 76 are connected to the main grip body 37, and in particular according to FIG. 2 are embodied as one part with the main grip body 37.

The eight bending beams 74, 76 stand, in the example according to FIG. 3, like the legs of a spider on the main grip body 37. If a force oriented substantially transversely to the grip axis 28 now acts on the end cap 78, the bending beams 74, 76 can elastically bend or deform such that the end cap 78 is deflected or tilted out of its rest position extending substantially perpendicularly to the grip axis 28. When this force drops, the end cap 78 returns to its rest position. In other words, the main grip body 37 tilts with respect to the end cap 78 under force action.

During operation of the hammer drill 10 according to FIG. 1, vibrations occur which pass, in the form of housing oscillations on the housing 12, onto the clamping band device 40 and thus onto the fastening device 30 in particular via the neck region 20. The oscillations applied to the fastening unit 30 cause a deflection of the end cap 78 as per the context outlined above. In this way, the bending elements 74, of the damping unit 32 act in a compensating or damping manner on the vibrations applied to the fastening unit 30, with the result that an operator of the hammer drill 10 can be effectively decoupled from the housing oscillations that occur.

The contact spacing d of the contact surface 68 from the support surface 70 is in this case selected such that the two surfaces come substantially neither partially nor fully into abutment in a regular operating state of the hammer drill 10. As a result, a force flux is already prevented in the regular operating state from being able to be passed via the support element 64, which would disadvantageously result in an action contrary to the vibration damping of the damping unit 32 with respect to the vibrations transmitted to the main grip body 37. A force flux 80 applied to the fastening unit 30 and caused by the mentioned vibrations is thus passed via the damping unit 32 as a single force flux path 80*a*, 80*b*.

If the force, caused by vibrations or in particular temporary impact pulses—for example as a result of loads caused by dropping—on the bending elements 74, or the end cap 78 rises beyond a design-related maximum value, greater tilting, caused thereby, of the end cap 78 with respect to the main grip body 37 results in the contact surface 68 coming at least partially, on a support contact surface 82, into touching, in particular supporting contact with the support surface 70. Via the support contact surface 82, a part of the force flux 80 applied to the fastening unit 30 can now flow off via the support element 64 rather than via the damping unit 32. An additional force flux path 80*a*, 84 forms temporarily as a bypass to the force flux path 80*a*, 80*b* via the damping unit 32.

Depending on the force occurring as an overload, a size of the support contact surface 82 changes such that an increasing overload force is accompanied by an increasing size of the support contact surface 82. Advantageously as a result, a larger part of the force flux 80 applied to the fastening unit 30 is increasingly passed via the additional force flux path 80*a*, 84 acting as a bypass.

Figure 4:
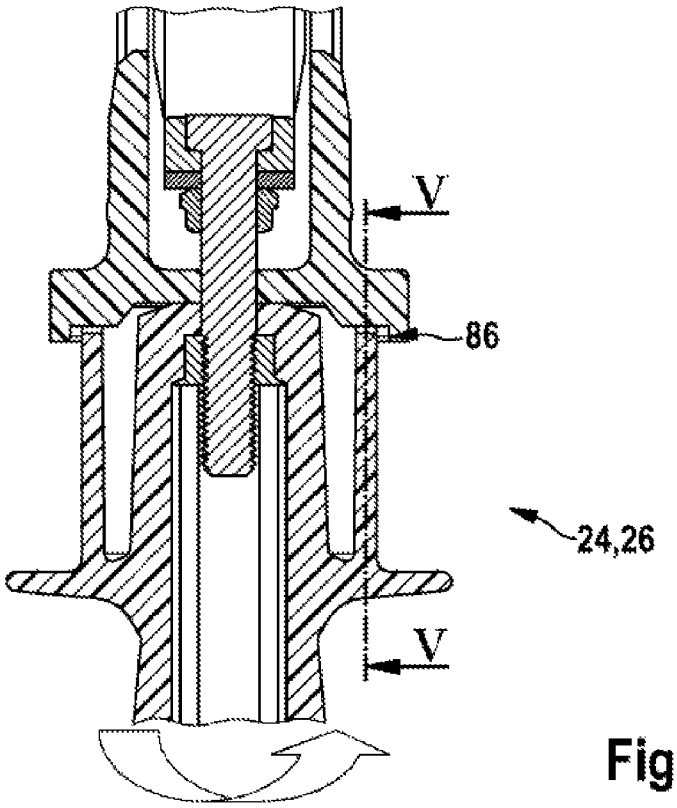
FIG. 4 shows a sectional view similar to FIG. 2 of a second exemplary embodiment

FIG. 4 shows an advantageous further development of the handle device 24, 26 according to the disclosure according to FIG. 2 as a second exemplary embodiment. Identical features or features having the same effect as in the preceding exemplary embodiment are in this case denoted by the same reference signs.

In particular for handle devices 24, 26 according to the disclosure which have a known clamping band device 40 and which can be released or fixed by relative screwing of the grip unit 36 with respect to the fastening unit 30, it may be advantageous for at least one torsion inhibiting means 86 to be provided between the fastening unit 30 and the grip unit 36, said torsion inhibiting means 86 limiting torsional moments acting on the damping unit 32 to a maximum in the event of torsion of the grip unit 36 relative to the fastening unit 30.

Figure 5:
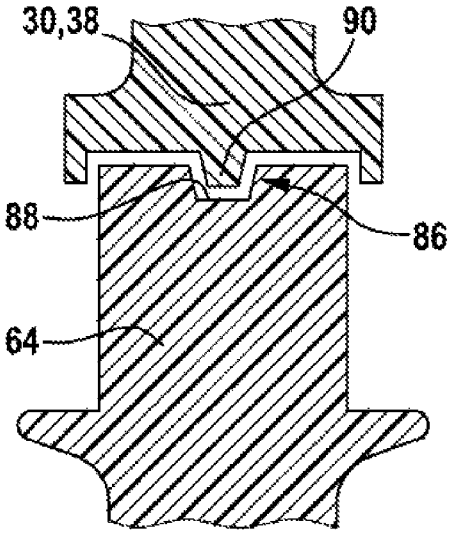
FIG. 5 shows a side view along the line A-A in FIG. 4

In the example according to FIG. 4, two groove-like recesses 88 which extend transversely to the contact surface 68 are provided for this purpose in the hollow-cylindrical support element 64. Furthermore provided on the fastening unit 30 are torsion blades 90 which are arranged in the support surface 70 facing the contact face 68, radially with respect to the bore 52. In an assembled state, these torsion blades 90 each project into one of the recesses 88, such that in the event of a relative rotation of the fastening unit 30 with respect to the grip unit 36, the flanks 88*a*, located in the direction of rotation, of the recesses 88 come into contact in a supporting manner substantially in the circumferential direction with the flanks 90*a* of the associated torsion blades 90, as is illustrated in particular in FIG. 5. As a result, in particular excessive rotational loading of the damping unit 32, in particular of the bending elements 74, 76, with respect to the end cap 78 or the main grip body 37 can advantageously be prevented.

Instead of the two pairs, shown here by way of example, of recesses 88 and torsion blades 90, a different number—preferably one pair, three pairs or four pairs—can also advantageously be provided. Also, the arrangement of the recess and torsion blade between the support element 64 and fastening unit 30 can be exchanged or else formed in an alternating manner.

Furthermore, further configurations of torsion inhibiting means 86, for example pins, in particular eccentrically placed pins through the first and second abutment surfaces 44, 46, surface structures in the first and second abutment surfaces 44, 46 or additional sleeve-like engaging elements between the fastening unit 30 and overload protection unit 34, in particular support element 64, are known to a person skilled in the art, and can advantageously be used in a modification of the exemplary embodiment according to the disclosure without impairing the inventive concept.

Figure 6:
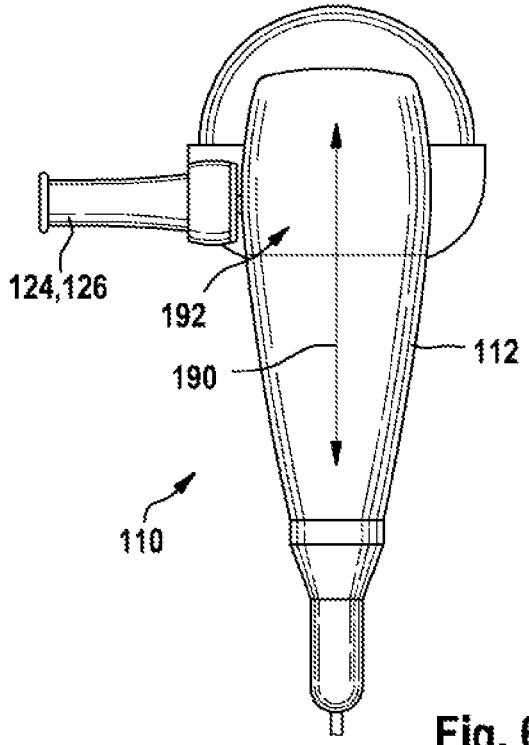
FIG. 6 shows a schematic view of an electric hand tool having a third exemplary embodiment in the form of an auxiliary handle

FIG. 6 shows an angle grinder or cut-off grinder 110 as a further example of a hand tool, in particular of a motor-driven hand tool having a further exemplary embodiment of the handle device 124 according to the disclosure in the form of an auxiliary handle 126. Identical features or features having the same effect as the previous exemplary embodiments are in this case illustrated with reference signs increased by 100.

The angle grinder or cut-off grinder 110 has a housing 112 having a main direction of extension 190. The handle device 124, 126 is arranged, in particular fitted, on a drive head region 192 of the housing 112, in a direction substantially perpendicular to the main direction of extension 190.

The handle device 124, 126 has a similar structure to the exemplary embodiments already known from the preceding text according to FIGS. 1 to 5, reference being made essentially to the description thereof. In the following text, essentially the features that differ from the preceding embodiments are described.

The fastening unit 130 of the handle device 124, 126 comprises in this example a threaded pin 194 at an end remote from the grip unit 136, as can be seen particularly well in FIG. 7. The threaded pin 194 is in this case provided in particular to be received in a receiving bore—not illustrated here—arranged on the housing 112, in particular in the drive head region 192. For this purpose, this receiving bore has an internal thread matching an external thread of the threaded pin 194, such that the handle device 124, 126 can be fixed in particular by being screwed to the housing 112. In a preferred further development, two or more of such receiving bores—oriented in particular in different directions—can be provided on the housing 112, in particular in the drive head region 192, said receiving bores allowing optional attachment of the handle device 124, 126 according to the disclosure.

Instead of the threaded pin 194, other form-fitting and/or force-fitting elements, for example latching pins, latching hooks, eyelets or the like, may be provided on the fastening unit 130, said elements interacting with matching receiving and holding elements known to a person skilled in the art, instead of the receiving bore, such that the handle device 124, 126 can be connected, in particular releasably, to the housing 10, 110 of a hand tool.

FIG. 7 shows an enlarged detail of the exemplary embodiment according to FIG. 6. It can be seen here that, unlike in the embodiments according to FIGS. 1 to 5, the overload protection unit 134 is arranged, preferably integrally formed, on the fastening unit 130. In the present example, too, the overload protection unit 134 is in the form of a hollow-cylindrical support element 164. The support element 164 in this case encloses the damping unit 132 which is formed in an already known manner. However, it may also be advantageous for the overload protection unit 134 to have, instead of a substantially closed form, a sequence of individual support blades which surround the damping unit 132.

In its mode of operation, in particular with respect to the damping of vibrations and protection against overloading of the damping unit 132, the exemplary embodiment according to FIGS. 6 and 7 corresponds to the already known embodiments of a handle device 24, 26 according to the disclosure, and so reference is made to the description thereof.

FIGS. 8*a* and 8*b* show two further modifications of the already described exemplary embodiments. Identical features or features having the same effect as in the preceding exemplary embodiment are in this case designated with the same reference signs.

The exemplary embodiment according to FIG. 8*a* has a similar structure to the exemplary embodiment according to FIGS. 6 and 7. However, in this example, both the overload protection unit 134 and the damping unit 132 are connected to the fastening unit, and in particular are embodied as one part with the latter. The damping unit 132 is in this case connected to the grip unit 136, in particular to the main grip body 137, via a connecting member 196. The connecting member 196 may be embodied as a form-fitting and/or a force-fitting element, in particular as a screw connection. However, it may also be advantageous for the connecting member 196 to be configured as a cohesive connection or to be supplemented by a cohesive connection. In this case, suitable known cohesive connections are for example adhesive bonding, soldering, welding.

In its mode of operation, in particular with respect to the damping of vibrations and protection against overloading of the damping unit 132, the exemplary embodiment according to FIG. 8*a* corresponds to the already known embodiments of a handle device 24, 26, 124, 126 according to the disclosure, and so reference is made to the description thereof.

The embodiment according to FIG. 8*b* represents a modification of the example according to FIG. 8*a*. In this case, the damping unit 132 is connected as one part to the fastening unit 130. The overload protection unit 134, configured as a support element 164, is, on the other hand, connected as one part to the main body 137 of the grip unit 136. In a similar manner to FIG. 8*a*, the damping unit 132 and the main grip body 137 are connected via a connecting member 196.

In its mode of operation, in particular with respect to the damping of vibrations and protection against overloading of the damping unit 132, the exemplary embodiment according to FIG. 8*a* corresponds to the already known embodiments of a handle device 24, 26, 124, 126 according to the disclosure, and so reference is made to the description thereof.

Proceeding from the exemplary embodiments, described in the preceding text, of a handle device 24, 26, 124, 126 according to the disclosure, it will be easy for a person skilled in the art to make obvious modifications. In particular, for example by varying the design and/or the number of bending elements 74, 174, advantageous configurations of a handle device according to the disclosure can be achieved. In addition to the configuration, shown here, as an auxiliary handle 26, 126, the inventive concept can advantageously also be used as a main handle depending on the hand tool taken as a basis, for example in the case of hand tools which have a mainly stem-like elongate form.

The invention claimed is:

1. A handle device, comprising:

a grip unit;

a fastening unit;

a spring-elastic damping unit arranged between the grip unit and the fastening unit, said damping unit being configured to transmit a vibration that occurs on the fastening unit in an operating state of the handle device to the grip unit in an at least partially damped manner such that an operator is at least partially decoupled from the vibration, the damping unit including a number of elongated bending units extending along a longitudinal axis between the grip unit and the fastening unit to transmit a force flux therebetween along a force flux path parallel to said longitudinal axis; and an overload protection unit that, in the event of an overload state occurring on the grip unit or on the fastening unit, is configured to protect the damping unit from damage by diverting at least a part of the force flux between the fastening unit and the grip unit in the overload state as a bypass to an additional force flux path, the overload protection unit including a hollow cylindrical support element surrounding said damping unit and configured to transmit the part of the force flux along the additional force flux path that is parallel to the longitudinal axis.

2. The handle device as claimed in claim 1, wherein the grip unit comprises at least one main grip body.

3. The handle device as claimed in claim 1, wherein the fastening unit comprises at least one main body.

4. The handle device as claimed in claim 2, wherein the fastening unit comprises at least one main body, and wherein the damping unit is connected to one or more of the main grip body and the main body.

5. The handle device as claimed in claim 4, wherein the damping unit is formed as one part with the main grip body of the grip unit or as one part with the main body of the fastening unit.

6. The handle device as claimed in claim 4, wherein the number of elongated bending units includes a defined number of bending elements that substantially enclose a grip axis of the grip unit in the circumferential direction thereof.

7. The handle device as claimed in claim 6, wherein the bending elements are arranged in a manner directed substantially radially.

8. The handle device as claimed in claim 1, wherein the hollow cylindrical support element at least partially surrounds the damping unit in the circumferential direction.

9. The handle device as claimed in claim 2, wherein:

the fastening unit comprises at least one main body; and the overload protection unit is connected to the main grip body of the grip unit or to the main body of the fastening unit.

10. An auxiliary handle for a hand tool, comprising:

a handle device including:

a grip unit;

a fastening unit;

a spring-elastic damping unit arranged between the grip unit and the fastening unit, said damping unit being configured to transmit a vibration that occurs on the fastening unit in an operating state of the handle device to the grip unit in an at least partially damped manner such that an operator is at least partially decoupled from the vibration, the damping unit including a number of elongated bending units extending along a longitudinal axis between the grip unit and the fastening unit to transmit a force flux therebetween along a force flux path parallel to said longitudinal axis; and an overload protection unit that, in the event of an overload state occurring on the grip unit or on the fastening unit, is configured to protect the damping unit from damage by diverting at least a part of the force flux between the fastening unit and the grip unit in the overload state as a bypass to an additional force flux path, the overload protection unit including a hollow cylindrical support element surrounding said damping unit and configured to transmit the part of the force flux along the additional force flux path that is parallel to the longitudinal axis.

11. A hand tool, comprising:

one or more of a handle and an auxiliary handle having a handle device, the handle device including:

a grip unit;

a fastening unit;

a spring-elastic damping unit arranged between the grip unit and the fastening unit, a spring-elastic damping unit arranged between the grip unit and the fastening unit, said damping unit being configured to transmit a vibration that occurs on the fastening unit in an operating state of the handle device to the grip unit in an at least partially damped manner such that an operator is at least partially decoupled from the vibration, the damping unit including a number of elongated bending units extending along a longitudinal axis between the grip unit and the fastening unit to transmit a force flux therebetween along a force flux path parallel to said longitudinal axis; and an overload protection unit that, in the event of an overload state occurring on the grip unit or on the fastening unit, is configured to protect the damping unit from damage by diverting at least a part of the force flux between the fastening unit and the grip unit in the overload state as a bypass to an additional force flux path, the overload protection unit including a hollow cylindrical support element surrounding said damping unit and configured to transmit the part of the force flux along the additional force flux path that is parallel to the longitudinal axis.

12. The handle device as claimed in claim 1, wherein the handle device is configured for a hand tool.

13. The handle device as claimed in claim 2, wherein the grip unit consists of the main grip body.

14. The handle device as claimed in claim 7, wherein the bending elements are arranged in a radiating manner away from the grip axis.

15. The handle device as claimed in claim 8, wherein the support element virtually entirely surrounds the damping unit in the circumferential direction.

16. The handle device as claimed in claim 9, wherein the overload protection unit has a hollow cylindrically configured support element that at least partially surrounds the damping unit in the circumferential direction, the support element being connected to the main grip body of the grip unit or to the main body of the fastening unit and being formed as one part therewith.

* * * * *